United States Patent [19]

Gauthier et al.

[11] 4,326,587

[45] Apr. 27, 1982

[54] CASING HANGER AND STABILIZER APPARATUS AND METHOD

[76] Inventors: Charles F. Gauthier, P.O. Box 775; Michael L. Martin, P.O. Box 792, both of Lake Arthur, La. 70549

[21] Appl. No.: 163,928

[22] Filed: Jun. 27, 1980

[51] Int. Cl.[3] ..... E21B 19/10; E21B 33/04

[52] U.S. Cl. ..... 166/379; 166/93; 285/144

[58] Field of Search ..... 166/315, 93, 75 R, 86, 166/88; 285/140, 142, 143, 144

[56] References Cited

U.S. PATENT DOCUMENTS

| | | | |
|---|---|---|---|
| 1,627,945 | 5/1927 | Wigle | 285/142 X |
| 1,646,639 | 10/1927 | Crowell | 166/93 X |
| 2,144,227 | 1/1939 | Penick et al. | 285/142 |
| 2,712,455 | 7/1955 | Neilon | 285/144 |
| 2,768,007 | 10/1956 | Brenner | 285/140 |

*Primary Examiner*—Stephen J. Novosad
*Attorney, Agent, or Firm*—Keaty & Keaty

[57] ABSTRACT

A method and apparatus for stabilizing an interior surface pipe within an exterior casing pipe are disclosed. The casing stabilizer apparatus comprises a cylindrical separable hanger body made up of a pair of body half-sections. Each body half-section includes tapered exterior walls and an interior bore with serrated teeth therein for gripping a surface pipe placed within said bore when assembled. A downward depending lip portion defining a space for engaging the uppermost end of the exterior casing pipe is also provided on each hanger body half-section. A locking means is provided for securing the body half-sections together. The hanger body is attached to an interior surface pipe above the exterior casing pipe, and then lowered onto the exterior casing pipe.

12 Claims, 4 Drawing Figures

CASING HANGER AND STABILIZER APPARATUS AND METHOD

BACKGROUND OF THE INVENTION

1. Field of the Invention

The present invention relates to devices for stabilizing oil pipe casing. More particularly, the present invention relates to a casing stabilizer device for securing the head of an oil well casing during the drilling operations.

2. General Background and Prior Art

In the drilling of oil wells, it is critical that the well be drilled with utmost safety, yet with attempting to minimize the expense and time involved. At the present state of the art, the original bore of the well is drilled out to a shallow depth and an exterior casing pipe is inserted into the bore, the diameter of which ranges from approximately $13\frac{5}{8}$ inches up to 20 inches in diameter. The head of the casing is then secured with a blowout preventor so that the drilling out of the bore within that casing in order to accommodate the next smaller casing (hereinafter referred to as surface pipe) may be done so to a greater depth within the exterior casing bore and with a maximum of safety. This surface pipe will serve as a containment pipe for the actual drilling pipe for drilling the oil well itself. However, this surface pipe, also, must be secured with a blowout preventor apparatus so that when the oil well is actually drilled, the safety device is in place during the drilling operation.

In order to secure the surface pipe within the exterior casing, the present art involves the singular method of pouring liquid concrete into the space between the surface pipe and the exterior casing down the bore. The concrete is then allowed to at least partially dry (a process usually taking 12 to 18 hours) which, during this time, the oil well is shut down. Following the drying of the concrete, the surface pipe is then secure enough in place to be cut off a few feet from ground level, above the surface of the exterior casing, and the blowout preventor is then secured, usually through welding, onto the head of the surface pipe. The well then is now in readiness for the actual drilling operation to begin, the drill pipe and bit being lowered down into the interior of the surface pipe itself.

However, even with this method of securing the surface pipe, the surface pipe does not maintain stability. As the oil well itself is drilled, the impact and vibration of the drilling pipe as it rotates within the surface pipe bore during drilling, in effect, breaks up the concrete, the result being that the surface pipe becomes loose and increasingly unstable as the drilling goes to a greater depth.

At present, a second step is taken in the process, following the breaking of the concrete, which would involve pouring of an aggregate, such as for example, pea gravel into the space between the exterior casing and the surface pipe, in an effort to help stabilize the surface pipe by the pea gravel filling in the inter-concrete spaces and, hopefully, stabilizing the surface pipe enough to complete drilling of the well. This step also has shortcomings in that the pea gravel does not really stabilize the surface pipe and, in effect, simply serves as a buffer between the surface pipe and the exterior casing, often times resulting in the surface pipe being very unstable and the drilling operation having to slow down or even stop in order to restabilize the surface pipe within the exterior casing.

General Description of the Present Invention

The present invention solves the prior art problems and shortcomings in a simple, inexpensive and straightforward manner. The present invention provides for a device to be secured around the very head of the surface pipe as the surface pipe is lowered into the bore within the exterior casing, following pouring of concrete within the space between the exterior casing and the surface pipe. In effect, the stabilizing device would be of two equal halves, so that when each half is placed against the pipe, the device would completely encircle the pipe and form a secure metal collar around the exterior of the surface pipe. The exterior circumference of the device would be such that the lower end circumference of the device would be slightly less than the upper end circumference of the pipe, the effect being a "cork shape" of the device as it is set around the pipe. The interior surface of the device, which would make contact with the surface pipe itself, would be adapted with a series of upward-directional serrated edges, or "teeth", which would be heat treated and would have the capability of biting into the exterior surface of the surface pipe to prevent slippage. As the surface pipe is further lowered into the exterior casing with the casing stabilizer engaged around it, the lower end of the device, being of a lesser circumference than the upper end, would slip into the interior bore of the exterior casing, but as the device is lowered, the increased circumference would create a more snug fit of the exterior surface of the device against the interior wall of the exterior casing. This, in effect, would cause the device to enclose tighter around the surface pipe. The result being that the serrated teeth within the device would bite into the surface pipe and would, in effect, lock it in place and, thus, the surface pipe could not be lowered any further. The stabilizer device, once in place, would also be adapted with a top lip portion which would encircle and encase the top edge of the exterior casing pipe once the device is in place. This feature of the device would serve as a means for preventing the exterior pipe from splitting as the tremendous weight of the surface pipe is "hung" from the stabilizer within the bore of the exterior casing. The end effect being that, although the concrete has not yet dried, the surface pipe is held very secure by the stabilizing device at its surface and the securing of the blowout preventor onto the surface pipe may be done immediately, not having to wait for the concrete to dry, as is done at present.

Therefore, it is an object of the present invention to provide a device for stabilizing surface pipe within the bore of exterior casing.

It is a further object of the present invention to provide a casing stabilizer which is simple to operate, with minimal working parts, having only a body which consists of two separate identical portions which, after having been combined together, form a substantially cylindrical collar around the surface pipe.

It is a further object of the present invention to provide a casing stabilizer with a central orifice in the device body, the walls of which having a number of tapered edges forming teeth and designated for positive grip of the device around the walls of the casing pipe.

It is a further object of the present invention to provide a casing hanger body designed to hang the body on the edges of the exterior casing pipe wall with the outer casing supporting the inner casing on an annular shoulder portion.

It is another object of the present invention to provide a casing stabilizer device which secures the surface pipe immediately after lowering the surface pipe within the exterior casing.

It is another object of the present invention to provide a casing stabilizer device which is relatively inexpensive to manufacture and easy to put in use.

It is another object of the present invention to provide a casing stabilizer which both centers the inner casing within the second and simultaneously supports the center casing.

Another object of the present invention is to provide a casing stabilizer, wherein the outer casing is the structural support to support the inner casing.

Another object of the present invention is to provide a casing stabilizer useful in installations of varying casing diameters and of several concentric casing members.

Another object of the present invention is to provide a casing stabilizer which is constructed of a cylindrical body with a pair of body half sections, defining an interior bore when assembled.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
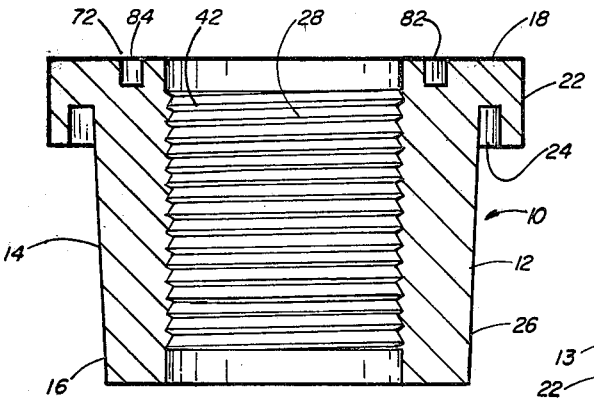
FIG. 1 is a perspective view of the half portion of the device of the present invention.
Figure 2:
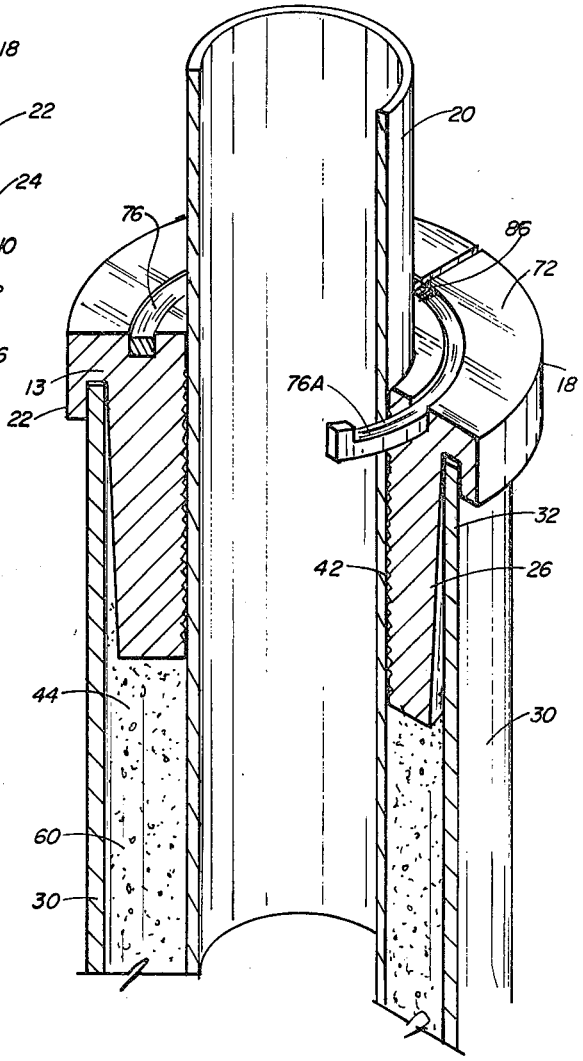
FIG. 2 is a perspective cross-sectional view of the casing pipe with the casing pipe and casing stabilizer installed within the exterior casing and securing the surface pipe.

FIGS. 1 and 2 best illustrate the preferred embodiment of the apparatus of the present invention designated generally by the numeral 10.

Casing stabilizer 10, as illustrated, comprises cylindrical body 12 which could be, for example, in two halves, one such half shown in cross-section in FIG. 1. Cylindrical body 12 could be a unitary molded piece of metal, approximately one foot in total length, which would be of slightly increased exterior circumference at top portion 14 than at lower portion 16. The effect would be a "cork" structure, the need for which will be made more evident as discussed further.

Figure 3:
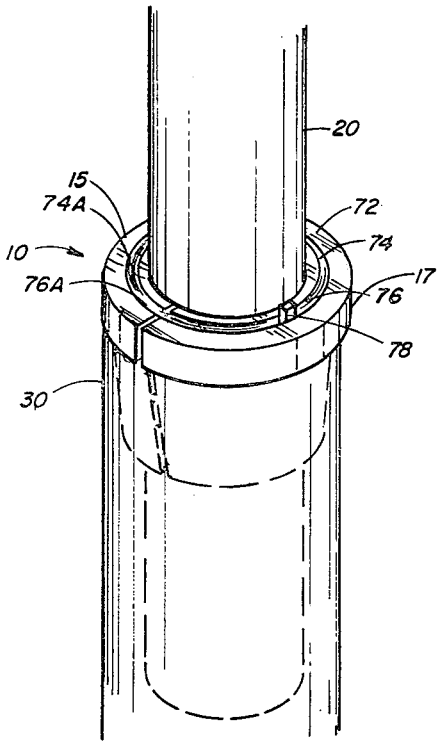
FIG. 3 is a perspective view of the exterior pipe in phantom, with the surface pipe and the casing stabilizer installed therein, and also showing the clamp means.

FIG. 1 illustrates upper portion 14 having an annular shoulder 18 and a downwardly depending lip 22, defining an open-ended space 24 around the upper portion 14 of apparatus 10. Space 24 will accommodate during operation the upper edge portion 32 of exterior casing pipe 30, once the apparatus 10 is placed in an operative position, as seen in FIGS. 2 and 3.

FIG. 1 illustrates bore 28 within casing stabilizer 10, which will accommodate surface pipe 20. The wall of bore 28 is provided with a series of preferably upwardly directional serrated edges 42 which, during operation, are biased inwardly to "bite" into the surface of surface pipe 30 while casing stabilizer 10 is lowered in place within the bore of exterior casing 30. The serrated edges, or "teeth", 42 in the preferred embodiment could be heat treated to produce sufficient hardness (for example, up to 50 Rockwells) in order to prevent the shearing off or breaking of the serrated edges 42 while the surface pipe is "hung" from the stabilizer 10 in the operative position. The "biasing" of edges 42 to grip pipe 20 is produced by providing an exterior wall 26 portion, which is tapered, with body 12 when assembled, having a smaller diameter at lower portion 16 than the larger diameter at upper portion 14. The tapering of exterior wall 26 of casing stabilizer 10 allows the lower portion 16 of stabilizer 10 to slip into the bore 44 of exterior casing 30. However, it is important to note that the tapering effect of apparatus 10 is simply to allow initial placement of the apparatus 10 within the exterior casing 30 while it is temporarily engaged around surface pipe 20, yet not fully secured within the bore 44 of exterior casing 30.

As is illustrated further in FIG. 2, stabilizer 10 is secured in place within exterior casing 30 following pouring of a flowable concrete mix as illustrated by numeral 60 within the area between the interior surface of exterior casing 30 and the exterior surface of surface pipe 20. This concrete 60 will have the effect of stabilizing surface pipe 20 somewhat during operation of the well. However, stabilizer 10, once in position as shown in FIG. 2, will stabilize the surface pipe immediately upon placement into position as illustrated.

FIG. 2 further illustrates top portion 13 of casing stabilizer 10 adapted with annular shoulder 18 and downwardly depending lip 22 defining open-ended space 24. The upper end edge 32 of exterior casing 30 is housed within space 24 of casing stabilizer 10. This is an essential feature, since as the surface pipe 20 is "hung" from the stabilizer 10 via the "teeth" 42 biting into its surface, the stabilizer 10 exerts tremendous pressure against the wall of exterior casing 30. This pressure would often times cause a rupture in the end portion 32 of the exterior casing 30, causing the well casing 30 to need replacement. The function of lip portion 22 would have the effect of housing the upper edge of the exterior casing 30 within space 24 and, thus, to prevent its moving outward and, thus, eventually rupturing.

FIG. 3 illustrates the concentric position of casing stabilizer 10 also within exterior casing 30, shown in phantom drawing and housing surface pipe 20. In the process of lowering the casing stabilizer 10 in place, a means is needed to maintain the two halves 15 and 17 of casing stabilizer 10 in place prior to their being lowered into position within exterior casing 30. This may be accomplished by adapting the top surface 72 of stabilizer 10 with a rectangular shaped channel 74 and 74A approximately one-half inch in depth and three-eights inches in width, which, when each half of the stabilizer 10 is positioned around surface pipe 20 prior to lowering into the exterior casing, the channel would form a continuous milled channel around and within top surface 72 of apparatus 10. Channel 74 and 74A would house respectively a section of three-eighths inch keystock 76 and 76A which would have the ability to be slidably moved within the channel.

Figure 4:
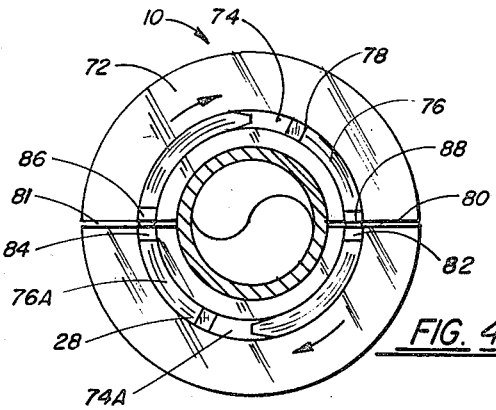
FIG. 4 is a top view of the device of the present invention installed within the exterior casing and securing the surface pipe.

FIG. 4 illustrates in top view the positioning of the keystock within channel 74 provided on the apparatus as in the locked position. It should be noted that keystock 76 would be adapted each with handle means 78 extruding out from the surface of apparatus 10, which handle means 78 would be grasped by the human hand and movement of the knob would impart movement of the keystock within the channel 74 and 74A. Please note that the keystock has been rotated approximately 180° within the channel, so that each section of the keystock in effect traverses space 80 and 81 between the two sections of apparatus 10, in effect, maintaining the apparatus as one entity. Also, it should be noted that keystock 76 and 76A is maintained within the channel by metal plates 82, 84, 86 and 88, which are fixed permanently within the channel flush with the top surface of apparatus 10. These metal plates would maintain the keystock within the channel, and would be welded or fixed in place following the placement of the keystock within the channel. FIGS. 1 and 3 would also illustrate the positioning of metal plates 82, 84, 86 and 88 after they had been fixed in place within channels 74 and 74A.

In the preferred embodiment, the casing stabilizer 10 would be approximately 12 inches in its total length, with the tapered edge from the top portion 14 to the bottom portion 16 of approximately 3° in the overall length. The thickness of stabilizer 10 at top portion 14 would be approximately one inch with lip portion 18 extended out one inch beyond the exterior wall of stabilizer 10. Downward depending lip 22 would be approximately two inches in overall length, with the overhang thickness of one-half inch. The inner space wall of overhanging lip 22 would define a space of approximately one inch in depth and one-half inch in width.

It should be noted that in the art the casing stabilizer 10 would be of various size bores and exterior circumferences due to the variable number of exterior casings and interior surface pipe sizes. Therefore, the casing stabilizer in most cases would have to be custom made for the particular use at a particular well site.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for stabilizing casing pipe, comprising:

(a.) a cylindrical body portion with an inner bore throughout;

(b.) a means for engaging pipe casing within said inner bore;

(c.) a portion of said cylindrical body adapted for hanging said body onto the uppermost end of exterior pipe casing comprising a downward depending lip portion defining a space being substantially equal in width to the thickness of the pipe wall for engaging the uppermost end of the exterior casing pipe;

(d.) a locking means for securing said apparatus around the pipe casing prior to lowering the apparatus in place.

2. The apparatus of claim 1, wherein the exterior wall of the cylindrical body portion is slightly tapered.

3. The apparatus of claim 1, wherein the cylindrical body portion is comprised of a pair of body half sections.

4. The apparatus of claim 1, wherein the engaging means is a plurality of upward directional serrated teeth within the wall of said bore.

5. The apparatus of claim 4, wherein the upward directional serrated teeth are heat treated to at least a 30 Rockwells hardness number.

6. The apparatus of claim 1, wherein the exterior circumference of the cylindrical body is substantially equal to the interior wall circumference of the exterior casing said body is fitted into.

7. The apparatus of claim 1, wherein the interior bore circumference of the cylindrical body is substantially equal to the exterior circumference of the surface pipe being engaged within.

8. The apparatus in claim 1, wherein the locking means comprises:

(a) a milled groove cut within the surface of the apparatus, defining a continuous channel around said surface;

(b) at least one length of metal keystock contained within said channel;

(c) a handle means attached to said keystock for slidably rotating said keystock within said channel;

(d) a means for maintaining said keystock within said channel.

9. The locking means of claim 8, wherein said keystock would have the ability to move slidably approximately one hundred and eighty (180) degrees and transverse said half sections of the apparatus.

10. An apparatus for stabilizing casing pipe, comprising:

(a) a cylindrical separable body comprising a pair of body half sections, each having tapered exterior walls and providing an interior bore when assembled;

(b) serrated teeth means in said bore for gripping a surface pipe placed within said bore;

(c) a downward depending lip portion on said body around its upper portion and defining a space for engaging the uppermost edge of an exterior casing pipe;

(d) locking means for securing said body half-sections together.

11. A method for stabilizing an interior surface pipe within an exterior casing pipe, comprising the steps:

(a.) providing a cylindrical separable hanger body comprising a pair of body half sections, each having tapered exterior walls and defining an interior bore with serrated teeth means therein for gripping a surface pipe placed within said bore when assembled and having an annular projecting shoulder portion with a downward depending lip portion defining a space for engaging the uppermost end of the exterior casing pipe;

(b.) providing a locking means for securing said half sections together;

(c.) attaching the hanger body to the interior surface pipe above the exterior casing pipe;

(d.) lowering the hanger body in the interior surface pipe above the exterior casing pipe.

12. The method of claim 11, wherein a further step comprises heat treating the upward directional serrated teeth to increase their hardness.

* * * * *